US010429799B2

(12) United States Patent
Hasegawa

(10) Patent No.: US 10,429,799 B2
(45) Date of Patent: Oct. 1, 2019

(54) ANALOG ELECTRONIC TIMEPIECE

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 55 days.

(21) Appl. No.: 14/995,991

(22) Filed: Jan. 14, 2016

(65) Prior Publication Data

US 2016/0266553 A1 Sep. 15, 2016

(30) Foreign Application Priority Data

Mar. 13, 2015 (JP) ..... 2015-050149

(51) Int. Cl.

| | |
|---|---|
| ***G04G 9/00*** | (2006.01) |
| ***G04B 19/23*** | (2006.01) |
| ***G04R 20/02*** | (2013.01) |

(52) U.S. Cl.

CPC ..... *G04G 9/0076* (2013.01); *G04B 19/23* (2013.01); *G04R 20/02* (2013.01)

(58) Field of Classification Search

CPC .... G04G 9/0076; G04B 19/025; G04B 19/22; G04B 19/23; G04R 20/02

See application file for complete search history.

(56) References Cited

U.S. PATENT DOCUMENTS

| | | | |
|---|---|---|---|
| 5,068,838 | A | 11/1991 | Klausner et al. |
| 5,375,018 | A | 12/1994 | Klausner et al. |
| 8,542,557 | B2 | 9/2013 | Oh |
| 8,705,321 | B2 | 4/2014 | Akiyama et al. |

(Continued)

FOREIGN PATENT DOCUMENTS

| | | | |
|---|---|---|---|
| EP | 2065768 | A2 | 6/2009 |
| EP | 2093634 | A2 | 8/2009 |

(Continued)

OTHER PUBLICATIONS

Extended European Search Report dated Jul. 18, 2016, issued in counterpart European Application No. 16151225.6.

(Continued)

*Primary Examiner* — Edwin A. Leon
*Assistant Examiner* — Jason M Collins
(74) *Attorney, Agent, or Firm* — Holtz, Holtz & Volek PC

(57) ABSTRACT

The analog electronic timepiece includes rotatable plural hands, a current position acquisition unit, a processor and a counting unit. The current position acquisition unit acquires a current position and stores local time settings therein. The local time settings include time zones and daylight saving time implementation information in each area. The processor rotates the plural hands, reads and acquires a local time setting corresponding to the acquired current position from the current position acquisition unit, and selects and sets a time zone. The counting unit counts the local time, based on a later action which the processor performs either the acquired local time setting or the set time zone. The processor controls at least one of the plural hands to display a local time determination result as to whether the counted local time is based on the acquired local time setting in correspondence to the current position.

20 Claims, 9 Drawing Sheets

| HOME POSITION | |
|---|---|
| CITY | : VIENNA |
| TIME ZONE | : UTC+1 |
| DAYLIGHT SAVING TIME IMPLEMENTATION TIME PERIOD | : 2 |
| DST SETTING | : AUTO |
| SUMMER SHIFT TIME | : +60 MINUTE |
| STANDARD RADIOWAVE | : NO |
| LATITUDE | : +48 |
| POSITIONAL INFORMATION | : YES |
| TZ OFFSET | : NO |
| DST OFFSET | : NO |

| WORLD TIME CLOCK POSITION | |
|---|---|
| CITY | : GUAM |
| TIME ZONE | : UTC+10 |
| DAYLIGHT SAVING TIME IMPLEMENTATION TIME PERIOD | : 0 |
| DST SETTING | : AUTO |
| SUMMER SHIFT TIME | : +0 MINUTE |
| STANDARD RADIOWAVE | : NO |
| LATITUDE | : +13 |
| POSITIONAL INFORMATION | : YES |
| TZ OFFSET | : NO |
| DST OFFSET | : NO |

(56) References Cited

U.S. PATENT DOCUMENTS

| | | | | |
|---|---|---|---|---|
| 2011/0063952 | A1 | 3/2011 | Baba | |
| 2011/0280108 | A1* | 11/2011 | Honda | G04R 20/06 368/21 |
| 2013/0052977 | A1* | 2/2013 | Akiyama | G04R 20/02 455/344 |
| 2014/0219068 | A1 | 8/2014 | Kyou | |
| 2014/0247700 | A1 | 9/2014 | Honda | |
| 2015/0253740 | A1* | 9/2015 | Nishijima | G04G 9/00 368/80 |
| 2015/0253742 | A1* | 9/2015 | Baba | G01S 19/24 368/14 |
| 2016/0223994 | A1* | 8/2016 | Honda | G04R 20/06 |
| 2016/0266548 | A1* | 9/2016 | Akiyama | G04B 27/002 |

FOREIGN PATENT DOCUMENTS

| | | | |
|---|---|---|---|
| JP | 06500629 | A | 1/1994 |
| JP | 2011048777 | A | 3/2011 |
| JP | 5630510 | B2 | 10/2014 |

OTHER PUBLICATIONS

Indian Office Action (and English language translation thereof) dated Jan. 4, 2019 issued in counterpart Indian Application No. 201614001441.

* cited by examiner

FIG. 3A

| HOME POSITION | | WORLD TIME CLOCK POSITION | |
|---|---|---|---|
| CITY | : GUAM | CITY | : --- |
| TIME ZONE | : UTC+10 | TIME ZONE | : UTC+1 |
| DAYLIGHT SAVING TIME IMPLEMENTATION TIME PERIOD | : 0 | DAYLIGHT SAVING TIME IMPLEMENTATION TIME PERIOD | : --- |
| DST SETTING | : AUTO | DST SETTING | : AUTO |
| SUMMER SHIFT TIME | : +0 MINUTE | SUMMER SHIFT TIME | : +0 MINUTE |
| STANDARD RADIOWAVE | : NO | STANDARD RADIOWAVE | : --- |
| LATITUDE | : +13 | LATITUDE | : --- |
| POSITIONAL INFORMATION | : YES | POSITIONAL INFORMATION | : NO |
| TZ OFFSET | : NO | TZ OFFSET | : NO |
| DST OFFSET | : NO | DST OFFSET | : NO |

FIG. 3B

| HOME POSITION | | WORLD TIME CLOCK POSITION | |
|---|---|---|---|
| CITY | : --- | CITY | : GUAM |
| TIME ZONE | : UTC+1 | TIME ZONE | : UTC+10 |
| DAYLIGHT SAVING TIME IMPLEMENTATION TIME PERIOD | : --- | DAYLIGHT SAVING TIME IMPLEMENTATION TIME PERIOD | : 0 |
| DST SETTING | : AUTO | DST SETTING | : AUTO |
| SUMMER SHIFT TIME | : +0 MINUTE | SUMMER SHIFT TIME | : +0 MINUTE |
| STANDARD RADIOWAVE | : --- | STANDARD RADIOWAVE | : NO |
| LATITUDE | : --- | LATITUDE | : +13 |
| POSITIONAL INFORMATION | : NO | POSITIONAL INFORMATION | : YES |
| TZ OFFSET | : NO | TZ OFFSET | : NO |
| DST OFFSET | : NO | DST OFFSET | : NO |

FIG. 3C

| HOME POSITION | | WORLD TIME CLOCK POSITION | |
|---|---|---|---|
| CITY | : VIENNA | CITY | : GUAM |
| TIME ZONE | : UTC+1 | TIME ZONE | : UTC+10 |
| DAYLIGHT SAVING TIME IMPLEMENTATION TIME PERIOD | : 2 | DAYLIGHT SAVING TIME IMPLEMENTATION TIME PERIOD | : 0 |
| DST SETTING | : AUTO | DST SETTING | : AUTO |
| SUMMER SHIFT TIME | : +60 MINUTE | SUMMER SHIFT TIME | : +0 MINUTE |
| STANDARD RADIOWAVE | : NO | STANDARD RADIOWAVE | : NO |
| LATITUDE | : +48 | LATITUDE | : +13 |
| POSITIONAL INFORMATION | : YES | POSITIONAL INFORMATION | : YES |
| TZ OFFSET | : NO | TZ OFFSET | : NO |
| DST OFFSET | : NO | DST OFFSET | : NO |

(CONT.)

(FIG. 4 CONTINUED)
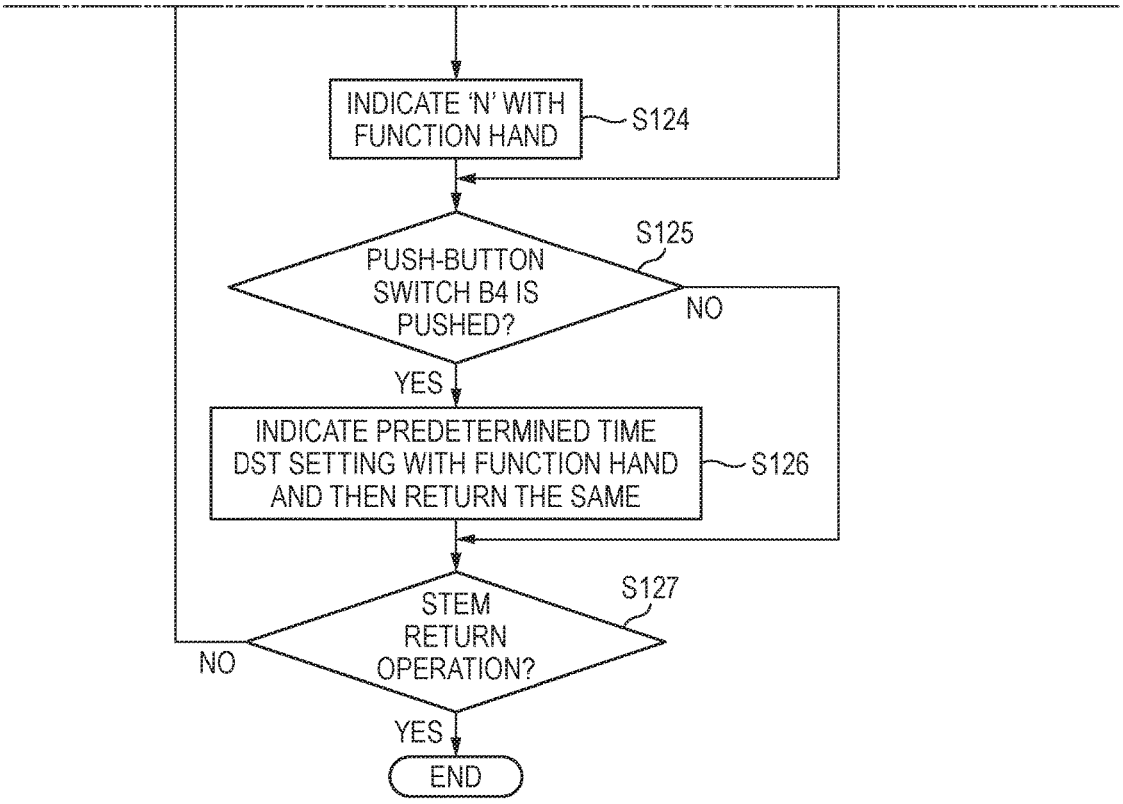

ANALOG ELECTRONIC TIMEPIECE

CROSS-REFERENCE TO RELATED APPLICATION

This application is based upon and claims the benefit of priority from the prior Japanese Patent Application No. 2015-050149, filed on Mar. 13, 2015, and the entire contents of which are incorporated herein by reference.

BACKGROUND OF THE INVENTION

1. Field of the Invention

The present invention relates to an analog electronic timepiece capable of displaying times in various areas of the world.

2. Description of the Related Art

In the related art, an electronic timepiece capable of displaying local times in various areas of the world has been known. According to the electronic timepiece, when any one time zone is designated by a user input operation and the like, local time in the time zone is calculated and displayed based on time difference information from coordinate universal time (UTC), and the like. Also, an electronic timepiece having a world time clock function of simultaneously or switchingly displaying local time in a desired area of the world in addition to the display of the usual time (local time) has been known.

According to an analog electronic timepiece configured to display date and time with hands, a peripheral edge portion of a dial plate at which marks and scales are arranged, a bezel or the like is provided with local time marks such as cities of the world indicating respective time zones, areas and time differences from coordinate universal time (UTC) in an annular shape. A user is enabled to designate a desired time zone by indicating any one of the local time marks with one hand, and local time is calculated and displayed in the designated time zone.

In the meantime, an electronic timepiece (a radiowave timepiece) has been recently known which is configured to receive radiowaves (a navigation message) from positioning satellites, to perform positioning, to determine a time zone to which the obtained position belongs, and to calculate and display local time in the time zone. The radiowaves from the positioning satellites can be received in various areas of the world in which the radiowaves can be received such as open outdoors. Thus, an appropriately setting can be made even though a user does not recognize a time zone at a current position.

However, in some areas of the world, for the summer season, the daylight saving time (Daylight Saving Time (DST)) during which time is made to deviate from the standard time of local time in a time zone is implemented. Therefore, in order to correctly display the local time, it is necessary to count and display date and time by additionally deviating a shift time during the daylight saving time implementation from the standard time over a daylight saving time implementation time period. Regarding this, JP-A-2011-048777 discloses a technology of associating and storing information about daylight saving time implementation time periods with respective areas of the world, determining start date and time and end date and time of the daylight saving time by using date and time information acquired from GPS satellites and correcting date and time during the daylight saving time implementation.

However, whether the daylight saving time is to be implemented and an implementation time period of the daylight saving time are determined within a range narrower than a setting range of the time zones, in many cases, and a plurality of areas in which different daylight saving time implementation rules are determined even in the same time zone is sometimes mixed. Therefore, in the analog electronic timepiece, when a local time setting by designation of a preset time zone and a local time setting based on any positional information such as positioning data are used in combination, even though a time zone is designated, it may not possible to automatically select an appropriate daylight saving time implementation rule and to apply the daylight saving time. As a result, the user may not recognize whether the daylight saving time corresponding to the current position has been applied to the calculated local time.

SUMMARY OF THE INVENTION

It is therefore an object of the present invention to provide an analog electronic timepiece with which a user can easily know whether local time to which the appropriate daylight saving time corresponding to a current position has been applied is obtained.

In order to achieve the above object, the present invention provides an analog electronic timepiece. The analog electronic timepiece includes plural hands, a current position acquisition unit, a processor and a counting unit. The plural hands are rotatable. The current position acquisition unit acquires a current position and stores local time settings in the current position acquisition unit. The local time settings include time zones and daylight saving time implementation information in each area. The processor rotates the plural hands, reads and acquires a local time setting corresponding to the acquired current position from the current position acquisition unit, and selects and sets a time zone. The counting unit counts local time. The counting unit counts the local time, based on a later action which the processor performs either the acquired local time setting or the set time zone. The processor controls at least one of the plural hands to display a local time determination result as to whether the counted local time is based on the acquired local time setting in correspondence to the current position.

According to the present invention, the user can easily know whether the local time to which the appropriate daylight saving time corresponding to the current position has been applied is obtained in the analog electronic timepiece.

BRIEF DESCRIPTION OF THE DRAWINGS

FIGS. 3A, 3B and 3C depict examples of a setting content of local time setting information.

DETAILED DESCRIPTION

Hereinafter, an illustrative embodiment of the present invention will be described with reference to the drawings.

Figure 1:
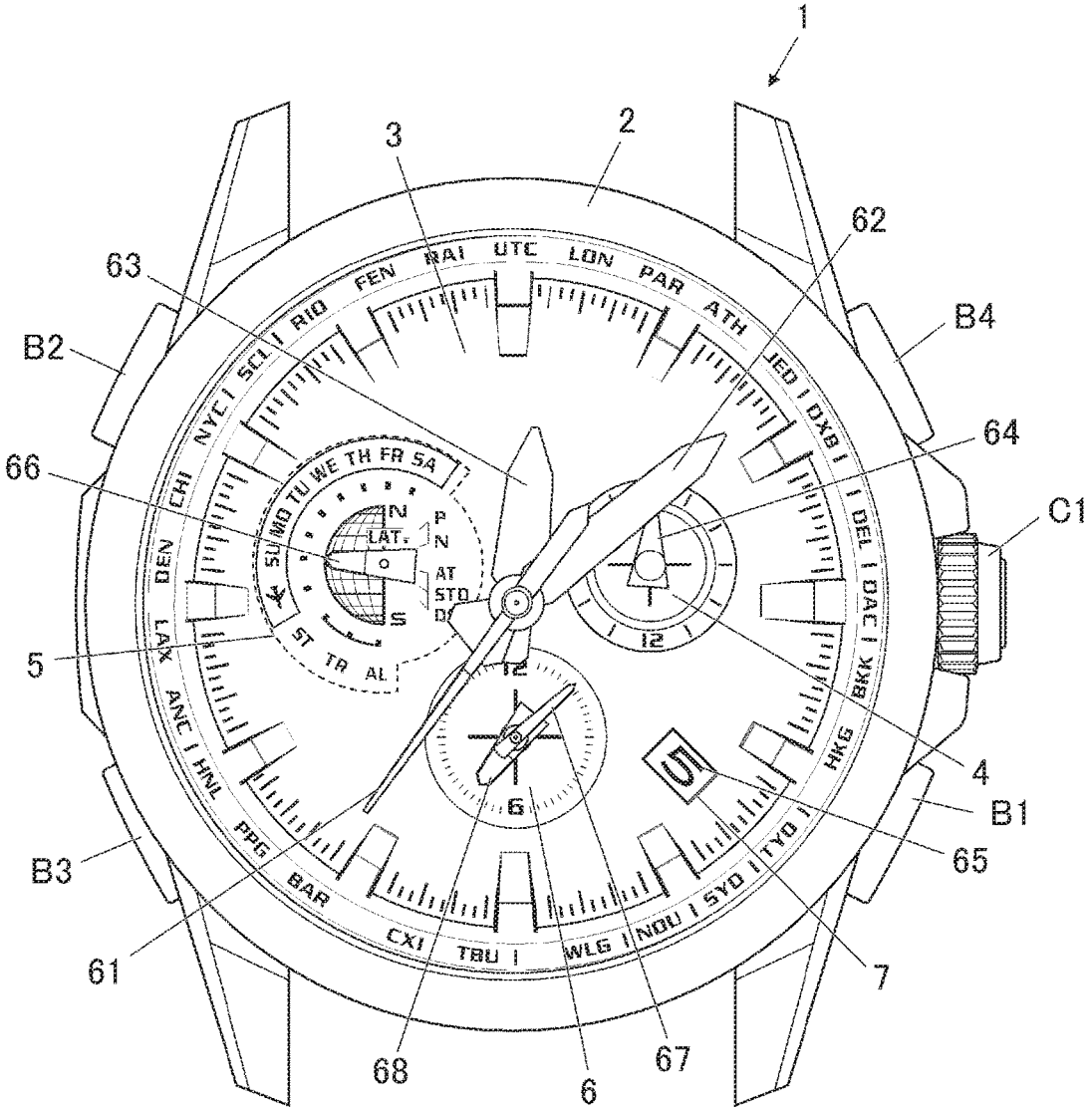
FIG. 1 is a front view of an analog electronic timepiece according to an illustrative embodiment of the present invention.

FIG. 1 is a front view of an analog electronic timepiece 1, which is an illustrative embodiment of the electronic timepiece of the present invention.

The analog electronic timepiece 1 includes a casing 2 configured to accommodate therein respective configurations, a dial plate 3 of which one surface (exposed surface) is externally exposed in the casing 2, a transparent member (windproof glass) (not shown) configured to cover the exposed surface of the dial plate 3, three time hands 61, 62, 63 configured to rotate about a substantial center (rotational shaft) of the dial plate 3 over a substantially entire surface of the dial plate 3 between the dial plate 3 and the windproof glass and to indicate marks and scales provided in the vicinity of an outer edge of the dial plate 3, a small window 4 provided at a two thirty position of the dial plate 3, a 24-hour hand 64 configured to rotate in the small window 4, a area 5 defined at a nine thirty position of the dial plate 3, a function hand 66 configured to rotate in the area 5, a small window 6 provided at a 6 o'clock position of the dial plate 3, a small minute hand 67 and a small hour hand 68 configured to rotate in the small window 6, a date wheel 65 provided on an opposite side to the exposed surface of the dial plate 3 in parallel with the dial plate 3 and configured to expose one mark thereof from an opening 7 provided at a four thirty position of the dial plate 3 in correspondence to a rotating operation, a stem C1 and push-button switches B1 to B4 provided on a side surface of the casing 2 with respect to the exposed surface of the dial plate 3, and the like.

The dial plate 3 is provided with scales and marks (hour characters) indicative of an hour, a minute and a second in a circular ring shape, and is also provided at an outer more edge than the scales and the marks with local time marks indicative of abbreviations of city names corresponding to time zones of the world and coordinate universal time (UTC). In the meantime, the local time mark may be provided on a bezel, not the dial plate 3.

The time hands 61 to 63 are a second hand 61, a minute hand 62 and an hour hand 63, respectively, and are usually configured to indicate a second, a minute and an hour of time when displaying time. The 24-hour hand 64 is configured to display 24 hours including ante meridiem and post meridiem in the small window 4. Also, in the analog electronic timepiece 1 of the illustrative embodiment, the second hand 61 and the minute hand 62 are used for display and setting of various functions.

The date wheel 65 has marks, which are indicative of dates and are equidistantly provided in number order at a peripheral edge portion thereof. One of the marks is exposed from the opening 7, thereby indicating a date.

The function hand 66 is configured to indicate a day of week by indicating any one of seven marks provided between a 9 o'clock position and a 1 o'clock position in the area 5, and to indicate a function mode under execution by indicating any one of marks provided between a 6 o'clock position and a seven thirty position in the area 5. The function modes that can operate in the analog electronic timepiece 1 include, but are not particularly limited to, a stopwatch mode, a timer mode and an alarm mode. Also, when the function hand indicates one of marks provided between a 3 o'clock position and a 5 o'clock position, a display relating to a display setting of the daylight saving time is performed with respect to the time display mode. Also, an airplane mode of prohibiting communication radio waves from being transmitted and received can be set in parallel with the various function modes. When the function hand 66 indicates an airplane mark close to the 9 o'clock position, the airplane mode is displayed. Also, a mark 'P' provided in the vicinity of a 1 o'clock position and a mark 'N' provided in the vicinity of a 2 o'clock position indicate whether the local time being counted is determined based on the information about a current position. Further, a latitude is displayed by an angle (i.e., a position indicated by the function hand 66) between a direction indicated by the function hand 66 and a 9 o'clock direction (a horizontal direction when a 12 o'clock direction faces upward).

The small minute hand 67 and the small hour hand 68 are configured to display local time at a set position (world time clock position) relating to the world time clock function in the small window 6, respectively. That is, the analog electronic timepiece 1 of the illustrative embodiment can display the local times of two areas at the same time by the time hands 61 to 63 and the small minute hand 67 and the small hour hand 68. In the meantime, a small 24-hour hand configured to rotate in conjunction with the small minute hand 67 and the small hour hand 68 may be additionally provided to display ante meridiem and post meridiem even in the world time clock.

In the below, when collectively describing some or all of the time hands 61 to 63, the 24-hour hand 64, the date wheel 65, the function hand 66, the small minute hand 67 and the small hour hand 68, the description 'hands 61 to 68' (the plurality of hands) is made, for example.

The stem C1 and the push-button switches B1 to B4 are respectively configured to receive an input operation from a user. The stem C1 can be pulled out in two steps from the casing 2. At a one or two-step pullout state, when the stem is rotated by a predetermined angle, an operation signal is output, which is then used for various settings. When each of the push-button switches B1 to B4 is pushed, a type of the function mode is changed or an operation command allotted to each of the function modes is received.

Figure 2:
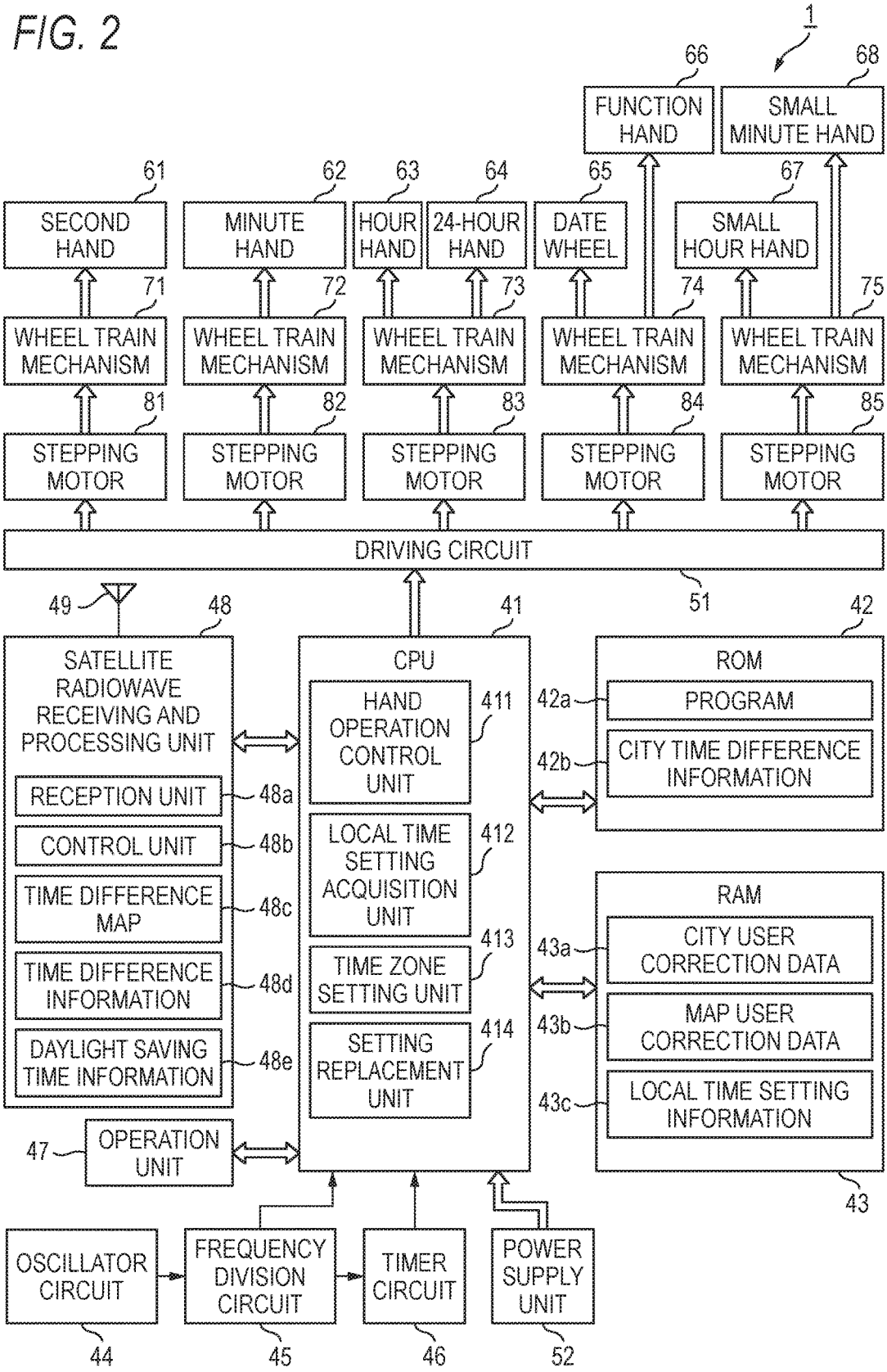
FIG. 2 is a block diagram depicting a functional configuration of the analog electronic timepiece.

FIG. 2 is a block diagram depicting a functional configuration of the analog electronic timepiece 1.

The analog electronic timepiece 1 includes a CPU 41 (Central Processing Unit) (an hand operation control unit 411, a local time setting acquisition unit 412, a time zone setting unit 413, a setting replacement unit 414), a ROM 42 (Read Only Memory), a RAM 43 (Random Access Memory) (the local time setting storage unit), an oscillator circuit 44, a frequency division circuit 45, a timer circuit 46 (the timer unit), an operation unit 47 (the operation receiving unit), a satellite radio wave receiving and processing unit 48 (the current position acquisition unit), an antenna 49 thereof, a driving circuit 51, a power supply unit 52, the time hands 61 to 63, the 24-hour hand 64, the date wheel 65, the function hand 66, the small minute hand 67, the small hour hand 68, wheel train mechanisms 71 to 75, stepping motors 81 to 85, and the like. The CPU 41 includes an hand operation control unit 411, a local time setting acquisition unit 412, a time zone setting unit 413, and a setting replacement unit 414. The hand operation control unit 411, the local time setting acquisition unit 412, the time zone setting unit 413, the setting replacement unit 414 may be a single CPU or may perform respective operations by CPUs separately provided.

The CPU 41 is configured to execute a variety of calculation processing and to collectively control the entire operations of the analog electronic timepiece 1. The CPU 41 is configured to control an hand operation relating to the display of date and time. The CPU 41 is configured to convert date and time, which is to be counted by the timer circuit 46, into appropriate local time based on a local time setting having time zone and daylight saving time implementation information, and to display the converted local time in a usual time display mode by the time hands 61 to 63, the 24-hour hand 64 and the date wheel 65.

Also, the CPU 41 is configured to operate the satellite radio wave receiving and processing unit 48 to acquire date and time and positional information. The CPU 41 is configured to correct the date and time that is to be counted by the timer circuit 46, based on the obtained data of date and time.

The ROM 42 is configured to store therein a program 42*a* for control, which is to be executed by the CPU 41, and setting data. The program 42*a* includes a program relating to operation control of various function modes, for example. Also, the setting data includes city time difference information 42*b*.

In the city time difference information 42*b*, IDs of geographical positions relating to the local time marks provided at the outer edge of the dial plate 3, positions (for example, the number of steps by the second hand 61 in a 12 o'clock direction) and time differences from the UTC time in the cities (hereinafter, the time difference indicates a time difference from the UTC time) are associated and stored as the time zone setting information. For example, regarding a city mark 'TYO' provided in the vicinity of a four twenty position and indicating Tokyo, an ID '011', a 22-second position and the time difference of +9 hours are associated and stored.

The RAM 43 is configured to provide the CPU 41 with a memory space for work and to store therein temporary data. Also, in the RAM 43, an acquisition hysteresis of the date and time information and positional information, local time setting information 43*c*, which is data of local time settings corresponding to a home position relating to a usual date and time display and a world time clock position relating to a world time clock display, data indicating hand positions, and the like are stored. Also, in the RAM 43, city user correction data 43*a* and map user correction data 43*b*, which are correction data of the time zone and daylight saving time implementation information set by the user, are stored.

When correction information of the time zone and the daylight saving time implementation information in each city is set, the correction information is stored in the city user correction data 43*a*. For example, when the daylight saving time is implemented in Tokyo, if the daylight saving time implementation information is set by the user, as described later, an ID indicating Tokyo and the like and the corresponding setting are associated and stored. The storing number of the setting may be the latest one, and the setting may be stored for all cities for which the setting is made. When a plurality of settings is made for the same city (ID), only the latest setting is stored. Also, the correction information may include an effective period of the correction information.

In the map user correction data 43*b*, when the correction information of the time zone and daylight saving time implementation information at the acquired current position (the latitude and the longitude) is set, an ID of the current position or a area (a predetermined area) including the current position and the set correction information are associated and stored. When the data indicating the current position is stored, the latitude and the longitude of the acquired current position may be used or coordinates of each geographical block stored in a time difference map 48*b* may be used. Also in this case, the number of settings is appropriately set in correspondence to the storage capacity and the like, and when a plurality of settings is made in the same area, only the latest setting is stored. This correction information may also include an effective period of the correction information.

The city user correction data 43*a* and the map user correction data 43*b* configure the update information.

In the local time setting information 43*c*, the local time setting information such as the time zone and the daylight saving time implementation rule at the home position and the world time clock position is stored. The local time setting information 43*c* will be described in detail later.

The oscillator circuit 44 is configured to generate and output a predetermined frequency signal. The oscillator circuit 44 has a quartz oscillator, as a vibrator, for example.

The frequency division circuit 45 is configured to divide the frequency signal output from the oscillator circuit 44 into signals of frequencies that are to be used by the CPU 41 and the timer circuit 46, and to output the same. The frequency to be output may be set to be changeable by a control signal from the CPU 41.

The timer circuit 46 is configured to count current date and time by counting and adding the frequency division signal input from the frequency division circuit 45 to an initial value indicating predetermined date and time. The date and time that is to be counted by the timer circuit 46 has an error (rate) corresponding to a degree of precision of the oscillator circuit 44, for example, about 0.5 second per one day. The date and time that is to be counted by the timer circuit 46 can be corrected by a control signal from the CPU 41. The date and time that is to be counted by the timer circuit 46 may be individual count values that can be converted into reference date and time such as UTC date and time, or may be UTC date and time itself. Alternatively, whenever a home position is set, the date and time may be corrected to local time (first local time) at the home position and counted. The timer circuit 46 may have a counter as a hardware configuration or may be configured to store a value counted in a software manner in the RAM and the like. Also, the software counting may be controlled by the CPU 41 or may be separately controlled.

Also, the timer circuit 46 may be configured to count local time at a world time clock position separately from the local time at the home position, and local time (second local time) at the world time clock position may be always converted from the date and time, which is to be counted by the timer circuit 46, and then output.

The operation unit 47 is configured to receive an input operation from the user. The operation unit 47 includes the push-button switches B1 to B4 and the stem C1. When the push-button switches B1 to B4 are respectively pushed or when the stem C1 is pulled out, pushed back or rotated, an electric signal corresponding to a type of the operation is output to the CPU 41. The stem C1 can be pulled out in two steps and receive an input of a content corresponding to the pullout state. In the analog electronic timepiece 1 of the illustrative embodiment, based on the user input operation, a home city setting and a city setting of the world time clock can be switched or replaced and a DST setting (which will be described later) relating to the daylight saving time applying to the local time can be made.

The satellite radio wave receiving and processing unit 48 is configured to receive radio waves from positioning satellites including positioning satellites (GPS satellites) relating to at least a GPS (Global Positioning System) by using the antenna 49, and to demodulate spectrum-spread transmission radio waves from the positioning satellites, thereby decoding and deciphering signals (navigation message data). In the satellite radio wave receiving and processing unit 48, a variety of calculation processing is additionally performed for contents of the deciphered navigation message data, as required, and at least a part of data of the acquired date and time and current position is output to the CPU 41 in a preset format, in correspondence to a request from the CPU 41.

The satellite radio wave receiving and processing unit 48 has a reception unit 48*a* (the satellite radiowave receiving unit), a control unit 48*b* (a microcomputer, a positioning unit) and a storage unit. The reception unit 48*a* has a reception circuit for amplifying, synchronizing and demodulating the radio waves from the positioning satellites. The control unit 48*b* is configured to control operations relating to reception, decipher, calculation and output. The calculation processing of the control unit 48*b* includes acquisition processing of date and time data and positioning calculation. The positioning calculation by the control unit 48*b* is not limited to a configuration where the positioning calculation is to be executed in a software manner, and may include at least a part of processing by a dedicated hardware circuit.

For the storage unit of the satellite radio wave receiving and processing unit 48, a non-volatile memory such as a flash memory and an EEPROM (Electrically Erasable and Programmable Read Only Memory) is used, so that the stored contents are kept, irrespective of the power feeding state to the satellite radio wave receiving and processing unit 48. In the storage unit, a time difference map 48*c*, time difference information 48*d* and daylight saving time information 48*e* for acquiring the local time setting information are stored in addition to a variety of operation control programs, predicted orbit information of the respective positioning satellites, which are to be acquired from the positioning satellites, and the setting data such as a leap second correction value. In the meantime, the local time setting information may be stored in the RAM 43 of the analog electronic timepiece 1, and the control unit 48*a* may be configured to receive the information from the CPU 41, as required, or the CPU 41 may be configured to execute the necessary processing. Also, the operation control programs may be stored in a dedicated ROM, read out upon startup and loaded to the RAM of the control unit 48*a*.

The time difference map 48*c* is map data in which a parameter relating to a time zone belonging to each of geographical blocks, which are obtained by dividing a world map into appropriate geographical blocks (geographical positions), and a parameter relating to the daylight saving time are stored. Although the map of the time difference map 48*c* is not particularly limited, a map in which latitude lines and longitude lines are denoted as linear lines and are drawn to orthogonally intersect is preferably used, and the respective geographical blocks are preferably arranged in a two-dimensional matrix shape at predetermined latitude and longitude intervals. Also, the geographical blocks are configured to have different longitude widths in high and low latitude areas so that actual sizes do not vary greatly between the geographical blocks.

The time difference information 48*d* is table data in which the parameter relating to the time zone, which is used in the time difference map 48*c*, and a time difference in the time zone are associated with each other. In the table data, the parameter is uniquely associated with the time difference in such a way that the time difference corresponding to a parameter '0' is '+0 hour' and the time difference corresponding to a parameter '1' is '+1 hour', for example.

Also, the daylight saving time information 48*e* is table data in which the parameter relating to the daylight saving time, which is used in the time difference map 48*b*, and content of the daylight saving time implementation information (whether the daylight saving time is to be implemented, the implementation time period and the shift time upon the implementation) are associated with each other. For example, the parameter '0' is associated with 'no implementation of the daylight saving time', and the parameter '1' is associated with a case where the daylight saving time is to be implemented from UTC 1:00 A.M on last Sunday in March to UTC 1:00 A.M. on last Sunday in October.

In this way, the parameter relating to the time zone and the parameter relating to the daylight saving time are defined for the same range as one area (predetermined area). Alternatively, even when the contents of the daylight saving time implementation information are the same, the parameter may be separately set for a different time zone and the parameter relating to the daylight saving time may be defined for the same range as one area. Also, the area may be determined by the contents of the daylight saving time implementation information and an administrative unit smaller than the time zone, for example.

The respective configurations of the satellite radio wave receiving and processing unit 48 are formed on a chip, as one integrated module, which is connected to the CPU 41. The on and off operations of the satellite radio wave receiving and processing unit 48 are controlled by the CPU 41, independently of the operations of the respective units of the analog electronic timepiece 1. According to the analog electronic timepiece 1, when it is not necessary to operate the satellite radio wave receiving and processing unit 48, the power feeding to the satellite radio wave receiving and processing unit 48 is stopped to save the power.

The power supply unit 52 is configured to feed power for operations of the respective units with a predetermined voltage. The power supply unit 52 has a battery. As the battery, a solar panel and a secondary battery are provided, for example. Alternatively, an exchangeable button-type dry cell may be used as the battery. Also, when a plurality of different voltages is output from the power supply unit 52, they can be converted and output into a predetermined voltage by using a switching power supply, for example.

The stepping motor 81 is configured to rotate the second hand 61 through the wheel train mechanism 71, which is an arrangement of toothed wheels. When the stepping motor 81 is driven one time, the second hand 61 is rotated by one step of 6 (six) degrees. The second hand 61 makes one round on the dial plate 3 by 60-times operations of the stepping motor 81.

The stepping motor 82 is configured to rotate the minute hand 62 through the wheel train mechanism 72. When the stepping motor 82 is driven one time, the minute hand 62 is rotated by one step of 1 (one) degree. The minute hand 62 makes one round on the dial plate 3 by 360-times operations of the stepping motor 82

The stepping motor 83 is configured to rotate the hour hand 63 and the 24-hour hand 64 through the wheel train mechanism 73. The wheel train mechanism 73 is configured to rotate the hour hand 63 and the 24-hour hand 64 in conjunction with each other. When the stepping motor 83 is driven one time, the hour hand 63 is rotated by one step of 1 (one) degree and the 24-hour hand 64 is rotated by a ½ degree. Therefore, when the hour hand 63 and the 24-hour hand 64 are rotated one time per 10 seconds, the hour hand 63 is rotated on the dial plate 3 by 30 degrees and the 24-hour hand 64 is rotated in the small window 4 by 15 degrees in one hour. That is, the hour hand 63 makes one round on the dial plate 3 for 12 hours and the 24-hour hand 64 makes one round in the small window 4 for 24 hours.

The stepping motor 84 is configured to rotate the function hand 66 and the date wheel 65 in conjunction with each other through the wheel train mechanism 74. When the stepping motor 84 is driven one time, the function hand 66 is rotated by one step of 1 (one) degree. The date wheel 65 is configured to rotate by 360/31 degrees by rotation of 150 steps, for example, so that the date mark to be exposed from the opening 7 is changed by one day. When the date wheel 65 is rotated by degrees corresponding to 31 days, the date mark indicating the first date is again exposed from the opening 7.

The stepping motor 85 is configured to rotate the small minute hand 67 and the small hour hand 68 through the wheel train mechanism 75. When the stepping motor 85 is driven one time, the small minute hand 67 is rotated by one step of 1 (one) degree and the small hour hand 68 is rotated by a 1/12 degree. Therefore, when the stepping motor 85 is driven 360 times, the small minute hand 67 makes one round in the small window 6 and the small hour hand 68 is rotated in the small window 6 by 30 degrees.

Although the time hands 61 to 63, the 24-hour hand 64, the date wheel 65, the function hand 66, the small minute hand 67 and the small hour hand 68 are not particularly limited, they are configured to be rotatable by 90 pps (pulse per second) in a forward rotation direction (clockwise direction) and to be rotatable by 32 pps in a reverse rotation direction.

The driving circuit 51 is configured to output a driving pulse of a predetermined voltage to the stepping motors 81 to 85, in response to a control signal from the CPU 41, thereby rotating the stepping motors 81 to 85 one time by a predetermined angle (for example, 180 degrees). The driving circuit 51 can vary a length (pulse width) of the driving pulse, depending on a state of the analog electronic timepiece 1, for example. Also, when a control signal for driving the plurality of hands at the same time is input, the output timings of the driving pulse may be made to be different so as to reduce the load.

In the below, the local time setting in the analog electronic timepiece 1 of the illustrative embodiment is described.

FIG. 3 depicts an example of a setting content of the local time setting information 43*c*.

The local time setting information 43*c* includes, for each of the home position and the world time clock position, information about a city (area) name, a time zone, a daylight saving time implementation time period, a DST setting, daylight saving time shift time, a standard radio wave that can be received at each of the home position and the world time clock position, a latitude and whether or not to apply the update information to the time zone and the daylight saving time implementation rule.

Here, as the local time setting relating to the home position, as shown in FIG. 3A, for example, the information about the island of Guam, which is a position acquired from a navigation message received from the positioning satellites, the information indicating that the time zone is UTC+10, the daylight saving time is not to be implemented and the like, are read out and stored from the time difference information 48*d* and the daylight saving time information 48*e*. In the meantime, the local time setting relating to the world time clock position is usually determined based on the setting of the time zone made by the user. Here, a area in which the time zone is UTC+1 is stored as the world time clock position. Also, for the home position and the world time clock position, 'AUTO' is set as the DST setting. The DST setting is to switch whether the implementation of the daylight saving time is to be automatically reflected in correspondence to the daylight saving time information 48*e* (AUTO) or is to be manually set to be on (DST) or off (STD) by the user. That is, here, the daylight saving time is to be implemented in accordance with the setting of the daylight saving time information 48*e* corresponding to a set position for any of the home position and the world time clock position.

Meanwhile, in the local time setting information 43*c*, an initial setting (preset data) is stored until the user first sets a time zone or a positioning is first performed to acquire a current position. For example, a country of dispatch (a country of sale), for example, Japan (UTC+9) is set for the time zone of the home position, and UTC time is set for the world time clock position.

In the case of the local time setting based on the time zone setting, the positional information is not kept, as compared to the local time setting based on the current position information, so that the city name, the daylight saving time implementation rule, the receivable standard radio wave and the latitude information are non-setting. In the meantime, regarding the daylight saving time implementation rule, the receivable standard radio wave and the like, the setting corresponding to the city that is to be used for the time zone setting may be made. In this case, in the local time setting information 43*c*, the setting relating to each city and the daylight saving time implementation rule and receivable standard radio wave corresponding to the city is read out from the city time difference information 42*b* and is included therein, the latitude is non-setting and the positional information is 'No.' These settings may be kept in the city time difference information 42*b* and applied to the local time setting information 43*c* for a time zone, which is not explicitly indicated as the city name on the dial plate 3 of FIG. 1 such as Lord Howe Island of UTC+10.5, and the setting relating to the city name, the daylight saving time implementation rule and the receivable standard radio wave may not be made only for such time zone.

At this situation, when the user moves to the world time clock position and the home position and the world time clock position are replaced with each other by the user operation, the local time setting relating to the home position and the local time setting relating to the world time clock position are replaced with each other in the analog electronic timepiece 1, as they are, as shown in FIG. 3B. At this situation, the date and time that is to be displayed as the world time clock by the small minute hand 67, and the small hour hand 68 is not Sidney corresponding to UTC+10 in FIG. 1 but is the local time based on the actually acquired position, and the home position is the setting (UTC+1) corresponding to the information of the manually selected time zone.

Further, when the positioning is performed with the settings being replaced with each other, a current position (Vienna) is specified based on the acquired latitude and longitude information, as shown in FIG. 3C, and the daylight saving time implementation information (the daylight saving time is implemented) and the receivable standard radio wave are set at the current position. Also, the latitude information is thus kept, so that the positional information 'Yes' is set. That is, at this situation, both the local time setting at the home position and the local time setting at the world time clock position are made based on the actually acquired positional information.

Meanwhile, here, when the local time setting at the current position is acquired, the old setting is overwritten and updated by the new setting. However, a predetermined number of local time settings may be stored and a previous setting may be called.

Therefore, both the home position and the world time clock position can be changed depending on whether they are based on the time zone information or the actually acquired positional information. At a state where the analog electronic timepiece 1 proceeds to a time zone change state of the home position or the world time clock position through the operation of the stem C1, the function hand 66 indicates the mark 'P' or 'N', so that it is explicitly indicated whether the home position and the world time clock position are changed based on the acquired positional information.

Figure 4:
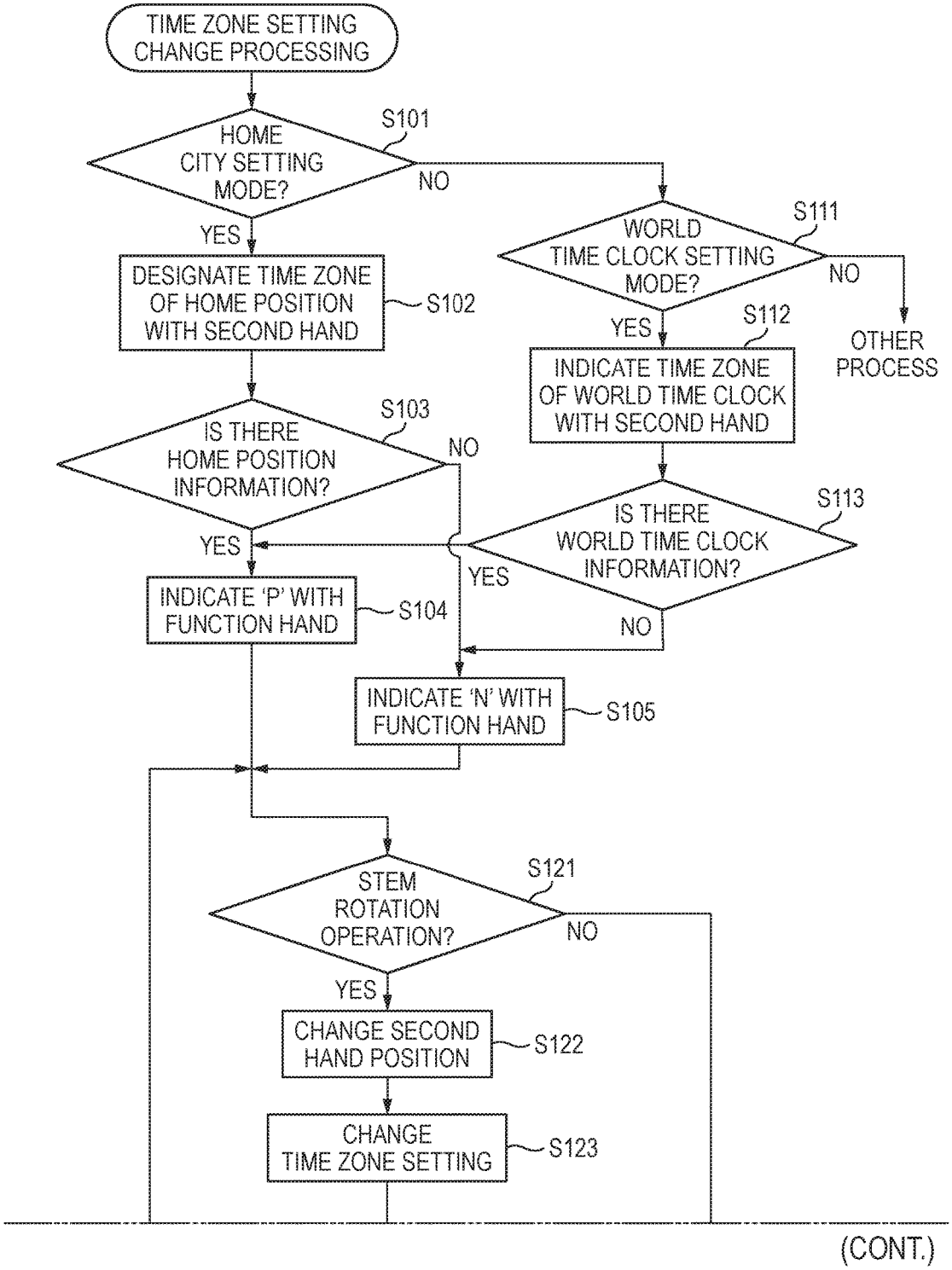
FIG. 4 is a flowchart depicting a control sequence of time zone setting change processing.

FIG. 4 is a flowchart depicting a control sequence of time zone setting change processing, which is to be executed in the analog electronic timepiece 1 of the illustrative embodiment by the CPU 41.

The time zone setting change processing starts when a shift operation to a time zone selection setting state to pull out the stem C1 in one step or two steps is detected at a usual date and time display state. The CPU 41 determines whether the mode is a home position setting mode (step S101). Specifically, the CPU 41 determines whether the stem C1 is pulled out in two steps. When it is determined that the mode is the home position setting mode ("YES" in step S101), the CPU 41 outputs a control signal to the driving circuit 51 and enables the second hand 61 (at least a part of the plurality of hands 61 to 68) to indicate a city of the time zone corresponding to the current home position, thereby displaying the time zone (step S102).

The CPU 41 determines whether the home position information is set in the local time setting information 43*c* (step S103). When it is determined (a local time determination result) that the home position information is set ("YES" in step S103), the CPU 41 outputs a control signal to the driving circuit 51 and enables the function hand 66 (at least a part of the plurality of hands 61 to 68; the hand different from the hand to display the time zone) to indicate the mark 'P' (step S104). Then, the processing of the CPU 41 proceeds to step S121. When it is determined that the home position information is not set ("NO" in step S103), the CPU 41 CPU 41 outputs a control signal to the driving circuit 51 and enables the function hand 66 to indicate the mark 'N' (step S105). Then, the processing of the CPU 41 proceeds to step S121.

When it is determined in the determination processing of step S101 that the mode is not the home position setting mode ("NO" in step S101), the CPU 41 determines whether the mode is a position setting mode of the world time clock (step S111). When it is determined that the mode is the position setting mode of the world time clock, i.e., when it is determined that the stem C1 is pulled out in one step ("YES" in step S111), the CPU 41 outputs a control signal to the driving circuit 51, and enables the second hand 61 to indicate a city mark corresponding to a value determined as the time zone of the world time clock (step S112). When it is determined that the mode is not the position setting mode of the world time clock ("NO" in step S111), the CPU 41 executes the other corresponding processing.

When the processing of step S112 is over, the CPU 41 determines whether the positional information relating to the world time clock display is set and kept in the local time setting information 43*c* (step S113). When it is determined that the positional information is kept ("YES" in step S113), the processing of the CPU 41 proceeds to step S104, and when it is determined that the positional information is not kept ("NO" in step S113), the processing of the CPU 41 proceeds to step S105.

When the processing proceeds to step S121, the CPU 41 determines whether the rotation processing of the stem C1 is performed (step S121). When it is determined that the rotation processing is performed ("YES" in step S121), the CPU 41 outputs a control signal to the driving circuit 51 and moves the second hand 61 to a mark position of a city corresponding to the rotation direction (step S122). Also, the CPU 41 changes the setting of the time zone in the local time setting information 43*c* (step S123). At this time, the CPU 41 can correct the local time being counted and output a control signal to the driving circuit 51 to correct a display time to the local time corresponding to the changed time zone. Alternatively, the local time correction may be performed after it is determined in determination of step S126 (which will be described later) that a return operation of the stem C1 is detected. Also, the CPU 41, outputs a control signal to the driving circuit 51 to enable the function hand 66 to indicate the mark 'N' (step S124). Then, the processing of the CPU 41 proceeds to step S125. When it is determined that the rotation processing is not performed ("NO" in step S121), the processing of the CPU 41 proceeds to step S125.

When the processing proceeds to step S125, the CPU 41 determines whether the push-button switch B4 is pushed (step S125). When it is determined that the push-button switch B4 is pushed ("YES" in step S125), the CPU 41 outputs a control signal to the driving circuit 51, enables the function hand 66 to indicate any one of 'AUTO', 'DST' and 'STD' relating to the DST setting for a predetermined time period and then returns the function hand 66 to any one position of the indicated marks 'P' and 'N' (step S126). Then, the processing of the CPU 41 proceeds to step S126. When it is determined that the push-button switch B4 is not pushed ("NO" in step S125), the processing of the CPU 41 proceeds to step S127.

When the processing proceeds to step S127, the CPU 41 determines whether an operation of returning the stem C1 to the initial position (an operation of ending the selection setting state of the time zone) is detected (step S127). When it is determined that the return operation is not detected ("NO" in step S127), the processing of the CPU 41 returns to step S121. When it is determined that the return operation is detected ("YES" in step S127), the CPU 41 ends the time zone setting change processing.

Figure 5A:
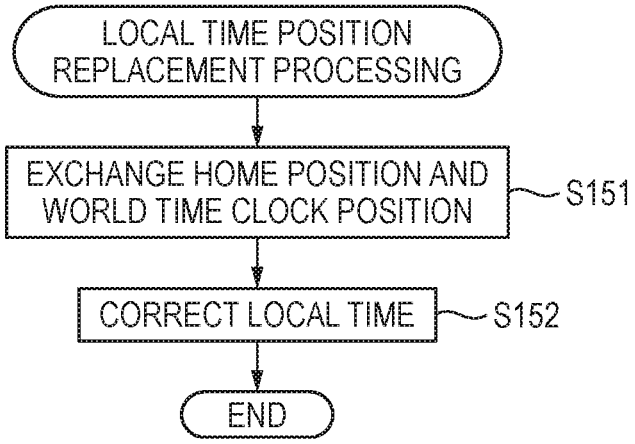
FIGS. 5A and 5B are flowcharts depicting a control sequence of local time position replacement processing and home position acquisition processing.
Figure 5B:
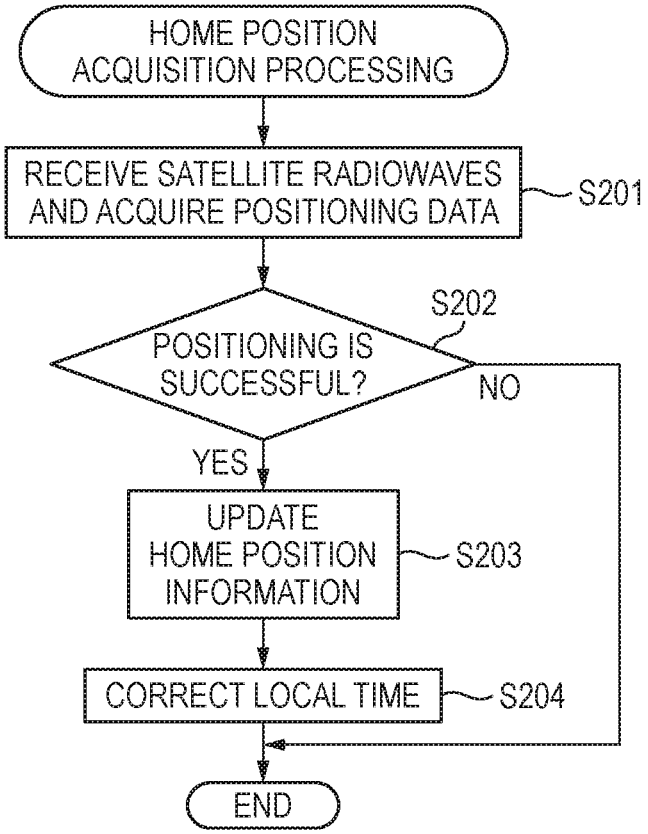

FIG. 5 is flowcharts depicting control sequences of local time position replacement processing (FIG. 5A) and home position acquisition processing (FIG. 5B), which are to be executed in the analog electronic timepiece 1 by the CPU 41.

The local time position replacement processing starts when it is detected that the push-button switch B4 is pushed for a predetermined time period in the usual date and time display state. When the local time position replacement processing starts, the CPU 41 replaces and updates the home position setting and the world time clock position setting stored in the local time setting information 43*c* (step S151), as shown in FIG. 5A.

The CPU 41 corrects the respective local times based on the replaced settings (step S152). The CPU 41 outputs a control signal to the driving circuit 51 to move the hands 61 to 65, 67, 68, thereby replacing time of the home position and time of the world time clock position. Alternatively, at this time, the CPU 41 may be configured to enable the second hand 61 to sequentially indicate the city marks corresponding to the time zones, to which the home position and the world time clock position belong, for a predetermined time period. After that, the CPU 41 ends the local time position replacement processing.

The home position acquisition processing starts based on a predetermined user input operation on the operation unit 47 or when a predetermined condition is satisfied. The predetermined condition may be a condition that a time zone setting of the home position is changed, a condition that an airplane mode is deactivated, and the like, for example.

When the home position acquisition processing starts, the CPU 41 activates the satellite radio wave receiving and processing unit 48 to receive radio waves from the positioning satellites and to perform the positioning, thereby acquiring the positioning data (step S201), as shown in FIG. 5. The positioning data to be acquire here includes the time zone information and daylight saving time implementation rule obtained based on the time difference map 48*c*, the time difference information 48*d* and the daylight saving time information 48*e*, in addition to the information of the current position.

The CPU 41 determines whether the positioning is successful (step S202). When it is determined that the positioning is not successful ("NO" in step S202), the CPU 41 ends the home position acquisition processing. When it is determined that the positioning is successful ("YES" in step S202), the CPU 41 updates the local time setting information 43*c* by using the acquired positioning data as the home position information (step S203).

The CPU 41 corrects the date and time that is corrected by the timer circuit 46, based on the local time acquired together (step S204). When the local time of the home position and the local time of the world time clock position are counted in conjunction with each other, the local time of the world time clock position is also corrected. Also, the CPU 41 outputs a control signal to the driving circuit 51 to correct the display time. Then, the CPU 41 ends the home position acquisition processing.

FIG. 6 depicts a display example upon the world time clock position setting in the analog electronic timepiece 1. Also, FIG. 7 depicts a display example upon the home position setting in the analog electronic timepiece 1.

Figure 6A:
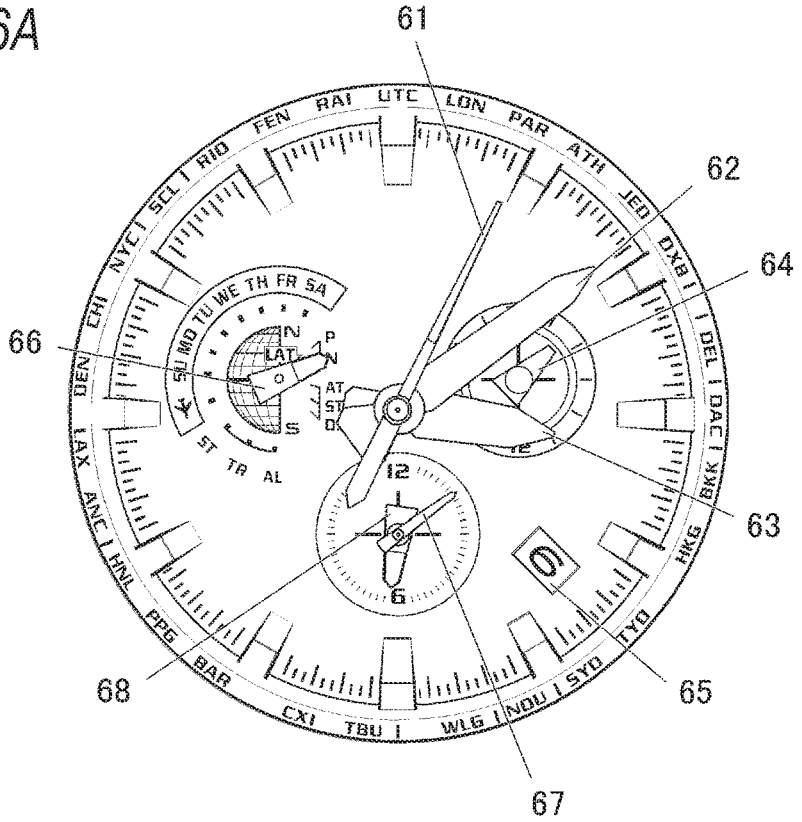
FIGS. 6A and 6B depict display examples upon world time clock position setting.

As described above, when the mode proceeds to the world time clock position change mode at a state where the time zone (UTC+1) is set as the world time clock position at the local time three nine (3:09) on sixth (seventeen nine (17:09) on fifth in UTC) in the island of Guam (UTC+10) (home position), the current time three nine (3:09) on sixth at the home city is indicated by the minute hand 62, the hour hand 63 and the 24-hour hand 64 and the time eighteenth nine (18:09) at the time zone (UTC+1) by the small minute hand 67 and the small hour hand 68, as shown in FIG. 6A. Also, the second hand 61 indicates a city mark 'PAR' (Paris), thereby indicating that the time zone of the world time clock position is (UTC+1). Also, the function hand 66 indicates the mark 'N', which indicates that the positional information of the world time clock position is not kept (i.e., only the time zone is set).

In the island of Guam, the daylight saving time is not implemented. Therefore, the displayed local time (3:09) on sixth is based on the standard time. Also, as described above, when the positional information of the world time clock position is not acquired, the daylight saving time of the standard time is displayed as the world time clock in the DST setting 'AUTO.'

Figure 6B:
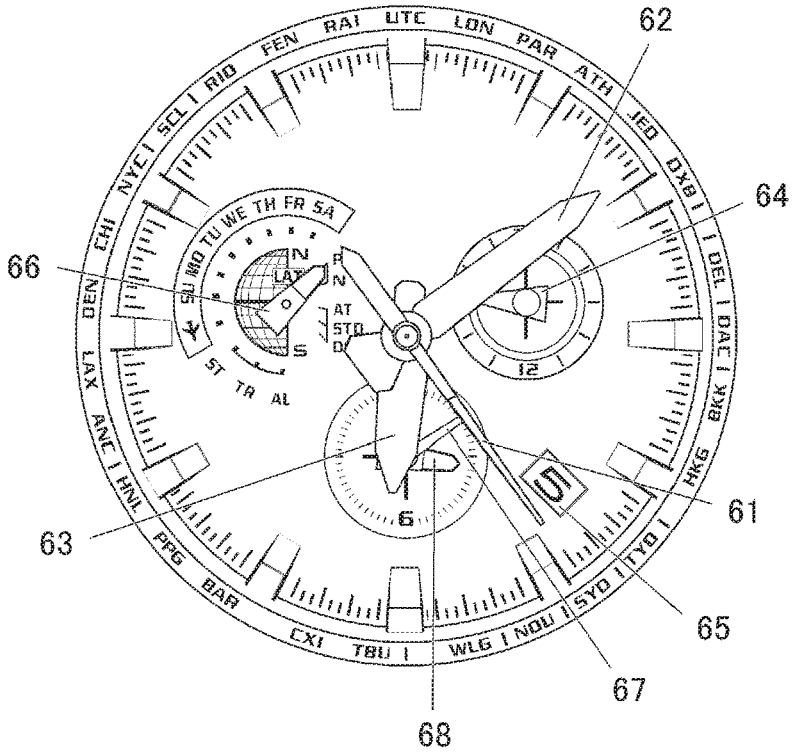

Here, after the world time clock position setting is once over and then the home position and the world time clock position are replaced, when the mode again proceeds to the world time clock position setting, the time eighteenth nine (18:09) on fifth at the time zone (UTC+1), which is the home position, is displayed by the minute hand 62, the hour hand 63 and the 24-hour hand 64, and the time three nine (3:09) at the island of Guam, which is the world time clock position, is displayed by the small minute hand 67 and the small hour hand 69, as shown in FIG. 6B. Also, at this time, the second hand 61 indicates a city mark 'SYD' and the function hand 66 indicates the mark 'P', thereby indicating that the positional information (the island of Guam) of the world time clock position is acquired and the position belongs to the time zone (UTC+10).

Figure 7A:
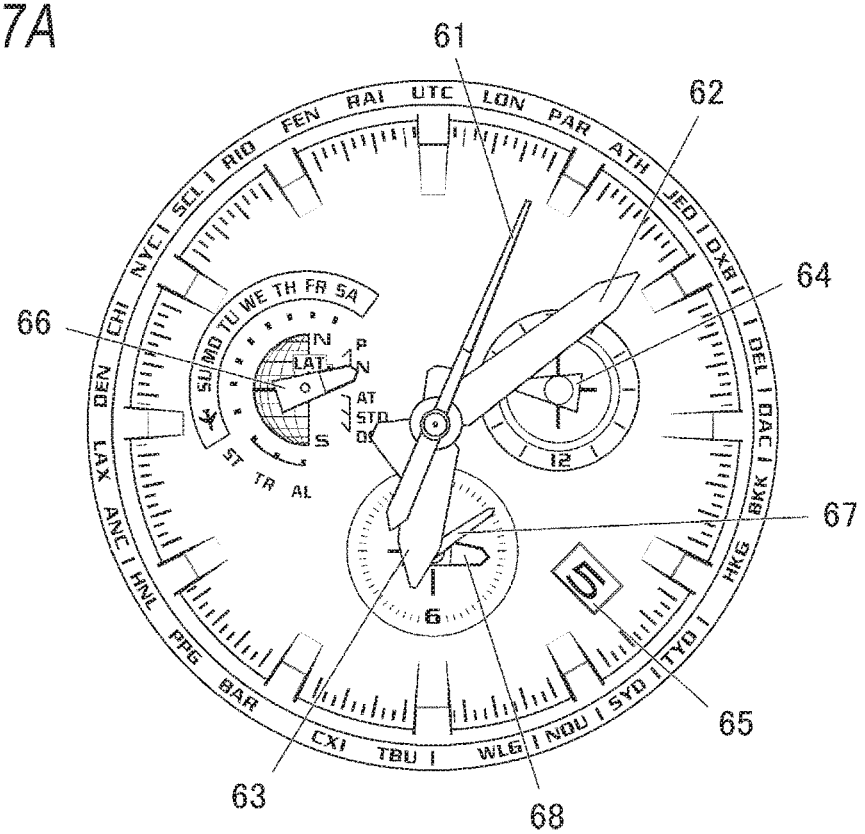
FIGS. 7A and 7B depict display examples upon home position setting.

When the mode proceeds to the home position change mode at this state, the function hand 66 indicates the city mark 'PAR' and the function hand 66 indicates the mark 'N', thereby indicating that the home position belongs to the time zone (UTC+1) and the positional information of the home position is not kept, as shown in FIG. 7A.

Figure 7B:
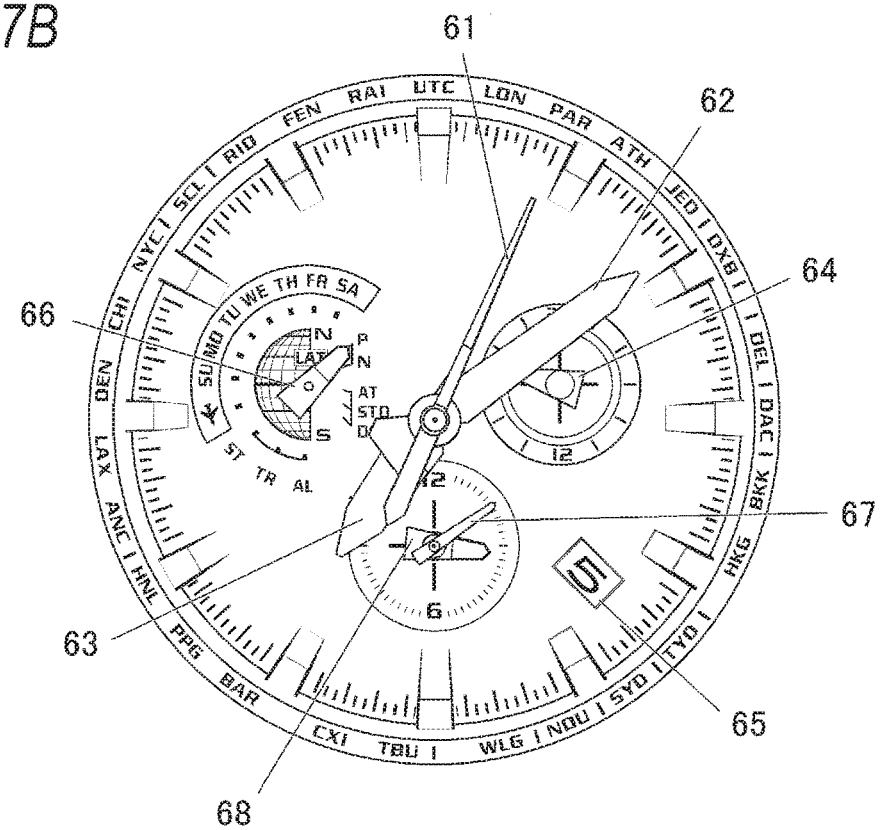

Thereafter, when the radio waves are received from the positioning satellites and the positioning is thus performed, the information of Vienna, which is the home position, is acquired and the function hand 66 indicates the mark 'P' at the home position change mode, thereby indicating that the information of the home position is kept, as shown in FIG. 7B. At this time, during the time period (from UTC one o'clock on final Sunday in March to UTC one o'clock on final Sunday in October) for which the daylight saving time is implemented in Vienna, the daylight saving time is applied as the local time of Vienna and nineteenth nine (19:09) on fifth is indicated by the hour hand 63, the minute hand 62 and the 24-hour hand 64 as time ahead of the standard time by one hour.

As described above, the analog electronic timepiece 1 of the illustrative embodiment has the plurality of hands 61 to 68 configured to be rotatable, the time difference map 48*c*, time difference information 48*d* and daylight saving time information 48*e* configured to store therein the local time settings having the time zones and daylight saving time implementation information in various areas of the world, the reception unit 48*a* and control unit 48*b* of the satellite radio wave receiving and processing unit 48 configured to acquire the current position, the timer circuit 46 configured to count the local time, and the CPU 41. The CPU 41 is configured to function as the hand operation control unit 411 configured to rotate the plurality of hands 61 to 68, the local time setting acquisition unit 412 configured to read out and acquire the local time setting corresponding to the acquired current position from the time difference map 48*c*, the time difference information 48*d* and the daylight saving time information 48*e*, and the time zone setting unit 413 configured to select and set the time zone.

The timer circuit 46 is configured to count the local time based on the more recently made one of the acquisition of the local time setting made by the CPU 41 configured to function as the local time setting acquisition unit 412 and the selection setting of the time zone made by the CPU 41 configured to function as the time zone setting unit 413, and the CPU 41 configured to function as the hand operation control unit 411 is configured to enable the function hand 66, which is at least a part of the plurality of hands 61 to 68, to make a display based on the local time determination result as to whether the counted local time is based on the local time setting acquired in correspondence to the current position.

In this way, when the counting of the local time based on the local time setting corresponding to the actually measured current position and the counting of the local time based on the determined time zone setting are used in combination, the display is made so that the user can easily recognize which configuration of the analog electronic timepiece 1 counts the local time. Thereby, the user can easily recognize whether the local time, to which the appropriate daylight saving time corresponding to the current position has been applied, is obtained.

Also, the CPU 41 configured to function as the hand operation control unit 411 is configured to enable the second hand 61, which is at least a part of the plurality of hands 61 to 68, to display the time zone to which the local time, which is being counted by the timer circuit 46, belongs. Therefore, the user can easily recognize to which time zone the counted date and time belongs and determine whether it is necessary to change the selection setting of the time zone and to correct the daylight saving time corresponding to the current position.

Also, the CPU 41 configured to function as the hand operation control unit 411 is configured to make a display based on the local time determination result and a display of the time zone at the same time by the different hands. Therefore, the user can efficiently acquire the information as to whether it is necessary to set the time zone and whether the daylight saving time is to be applied at the current area and can cope with the corresponding situations.

Also, the operation unit 47 configured to receive the user operation is provided, the timer circuit 46 is configured to count the local time at the home position and the local time at the world time clock position, respectively, and the CPU 41 configured to function as the hand operation control unit 411 is configured to enable the function hand 66 to display whether the date and time based on the local time setting at the current position has been counted in correspondence to the acquisition of the local time setting and/or the selection setting of the time zone made for each of the local time at the home position and the local time at the world time clock position.

Therefore, the user can easily check whether the current position information has been acquired with respect to each of the home position setting and the world time clock position setting, even though the user does not completely remember the same.

Also, it is possible to replace the local time setting relating to the local time at the home position and the local time setting relating to the local time at the world time clock position, in correspondence to the predetermined input operation on the operation unit 47. Therefore, it is possible to display the local time by easily reflecting the current position upon travel on company business to and from a specific destination. Also, at this time, since the local time setting relating to the current position acquired with respect to the home position is kept without being erased, it is possible to count the correct local time at the original home position even at the travel destination.

Also, the current position is acquired by the reception unit 48*a*, with which the satellite radio wave receiving and processing unit 48 receives the radio waves from the positioning satellites, and the control unit 48*b* configured to compute the current position based on the received radio waves from the positioning satellites. Therefore, since it is possible to securely acquire the correct current position in any area of the world in which the satellite radio waves can be received, such as open outdoors and a place near a window, it is possible to easily obtain the appropriate local time setting.

Also, when the current position computed by the control unit 48*b* of the satellite radio wave receiving and processing unit 48 is acquired, the CPU 41 configured to function as the local time setting acquisition unit 412 updates the local time setting relating to the local time at the home position, in correspondence to the acquired current position. Therefore, the home position setting is provisionally made in correspondence to the user setting until the current position is acquired, and when the current position is acquired, the correct local time can be immediately displayed based on the correct acquisition information.

Also, the CPU 41 configured to function as the time zone setting unit 413 is configured to select and set the time zone in correspondence to the operation content received through the operation unit 47, the operation unit 47 is configured to receive the shift operation to the selection setting state of the time zone relating to the local time at the home position and the ending operation of the selection setting state and the shift operation to the selection setting state of the time zone relating to the local time at the world time clock position and the ending operation of the selection setting state through the pullout and push-back operations of the stem C1, and the CPU 41 configured to function as the hand operation control unit 411 is configured to make a display based on the local time determination result relating to the local time at the home position at the selection setting state of the time zone relating to the local time at the home position, which state is made by the two-step pullout of the stem C1, and to make a display based on the local time determination result relating to the local time at the world time clock position at the selection setting state of the time zone relating to the local time at the world time clock position, which state is made by the one-step pullout of the stem C1.

That is, the operation relating to the display and the operation relating to the time zone setting are commonalized, so that the operation relating to the display can be simplified without unnecessarily increasing the same. Also, when there is a problem in the current setting, it is possible to correct the problem easily and immediately. Therefore, the user can quickly determine and perform the settings relating to the counting and display of the local time that is most appropriate at that state.

In the meantime, the present invention is not limited to the above illustrative embodiment and a variety of changes can be made.

For example, in the above illustrative embodiment, the mark 'P' or 'N' is indicated simply by whether or not the current position information. However, when there is the current position information, a latitude corresponding to the current position may be indicated by the function hand 66.

Figure 8:
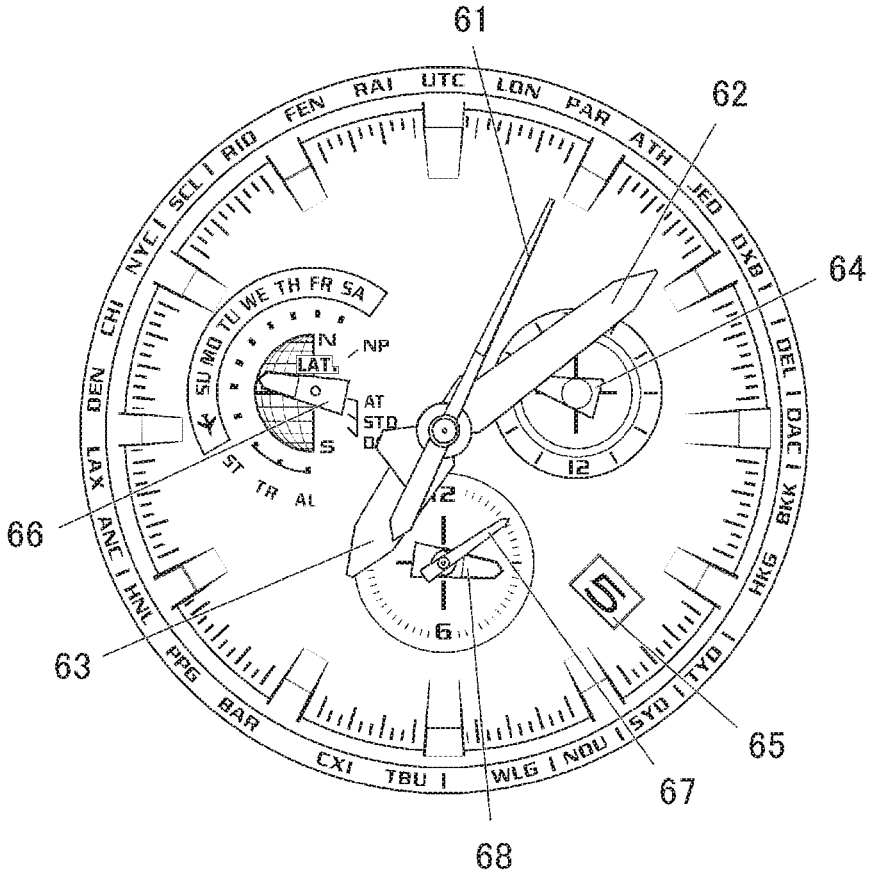
FIG. 8 depicts another display example upon the home position setting when current position information is kept.

FIG. 8 depicts another display example upon the home position setting when the current position information is kept.

As shown, the function hand 66 indicates the latitude (13 degrees North Latitude), thereby indicating that the current position information is kept and the current position being kept is the island of Guam. By this display, when the user moves among a plurality of positions in the same time zone, for example, the user can know which positional information is being kept. Also, in this case, since only a mark indicating that there is no current position has only to be provided, there is no mark 'P' and only a mark 'NP' corresponding to the mark 'N' is provided.

Also, in the above illustrative embodiment, the analog electronic timepiece capable of displaying the time of the home position and the time of the world time clock at the same time has been exemplified. However, an analog electronic timepiece configured to selectively switch any one display may also be possible. Alternatively, an electronic timepiece configured to display only the time of the home position may also be possible. In addition, the number, arrangement, utilities and the like of the hands are arbitrarily determined.

Also, in the above illustrative embodiment, the time difference information 48*d* and the daylight saving time information 48*e* are kept in the satellite radio wave receiving and processing unit 48, and the city time difference information 42*b* is kept in the ROM 42. However, the present invention is not limited thereto. For example, the corresponding information may be collectively kept in the ROM 42. In this case, the CPU 41 may be configured to compute the local time corresponding to a city (time zone), which is set by acquiring UTC date and time from the satellite radio wave receiving and processing unit 48, for example.

Also, in the above illustrative embodiment, the current position is acquired by the positioning based on the radio waves received from the positioning satellites through the satellite radio wave receiving and processing unit 48. However, the other methods are also possible. For example, the user may manually input approximate values of the latitude and the longitude. In this case, it is possible to manually input not only the home position but also the world time clock position.

Also, in the above illustrative embodiment, whether or not the current position relating to the home position and the world time clock position is displayed at each of the home position setting mode and the world time clock position setting mode. However, whether or not the current position may be displayed in the other operation modes. Also, in this case, the corresponding display may not be necessarily made at the same time as the display indicative of the time zone.

Also, in the above illustrative embodiment, the home position and the world time clock position can be replaced with each other but may be independently set, respectively. In this case, when the setting based on the current position cannot be performed as the world time clock, only whether or not the acquisition of the current position relating to the home position may be displayed.

Also, in the above illustrative embodiment, in the time zone setting change processing, the setting of the time zone is changed immediately in correspondence to the rotation processing of the stem C1. However, even though the rotation processing of the stem C1 is performed, the time zone may be changed only when the stem C1 is pushed back and the change to the other time zone is determined. Alternatively, even when the change of the time zone is finally made just one time at timing of the push-back of the stem C1, if the user moves to a area without changing the time zone, in which the daylight saving time implementation rule is different, the user may want to cancel only the daylight saving time implementation rule. Therefore, for example, even though the user finally returns to the same time zone, when the stem operation is performed one or more times during the processing, the setting of the time zone may be updated and more preferentially used than the local time setting.

In addition, the configuration, structure, control content, control sequence, display aspect and the like of the analog electronic timepiece 1 can be appropriately changed without departing from the gist of the present invention.

Although the illustrative embodiments of the present invention have been described, the scope of the present invention is not limited to the illustrative embodiments and includes the scope defined in the claims and the equivalent scope thereto.

What is claimed is:

1. An analog electronic timepiece comprising:

a plurality of hands that are rotatable;

a memory that stores both (i) local time setting information and (ii) update information to be applied to a time zone, the update information being correction information set by a user for correcting the local time setting information;

a current position acquisition unit that acquires a current position and that stores the acquired current position in the local time setting information in the memory, wherein the local time setting information includes time zone information, applying information which indicates whether or not to apply the update information, and daylight saving time implementation information for each of a plurality of areas;

a processor that rotates the plurality of hands, that reads and acquires a local time setting corresponding to the acquired current position from the memory, and that selects and sets a time zone; and a counting unit that counts local time, wherein the counting unit (i) counts the local time based on updated data of the local time setting information, which is generated by rewriting values of initial settings of the local time setting information to be updated values based on the update information, when the applying information included in the local time setting information indicates to apply the update information to the time zone, and (i) counts the local time based on the initial settings of the local time setting information, when the applying information included in the local time setting information indicates not to apply the update information to the time zone, and wherein the processor controls at least one of the plurality of hands to display a local time determination result as to whether or not the local time setting information stored in the memory, based on which the counting unit counts the local time, includes the acquired current position.

2. The analog electronic timepiece according to claim 1, wherein:

the processor controls at least one of the plurality of hands to display a time zone where the counted local time counted by the counting unit belongs.

3. The analog electronic timepiece according to claim 2, wherein:

the processor simultaneously controls one hand of the plurality of hands to display the local time determination result and another hand of the plurality of hands to display the time zone.

4. The analog electronic timepiece according to claim 3, further comprising:

an operation receiving unit that receives a user operation, wherein:

the counting unit counts first local time and second local time, respectively;

the processor respectively acquires first and second time settings and respectively sets first and second time zones, in correspondence to the counted first and second local times; and the processor controls at least one of the hands to display the local time determination result, in correspondence to the first time setting and the first time zone, or in correspondence to the second time setting and the second time zone.

5. The analog electronic timepiece according to claim 4, wherein:

the processor switches the first local time setting of the first local time and the second local time setting of the second local time, in correspondence to a predetermined input operation on the operation receiving unit.

6. The analog electronic timepiece according to claim 5, wherein:

the current position acquisition unit receives radio waves from positioning satellites and computes the current position based on the received radio waves from the positioning satellites; and when the current position acquisition unit acquires and computes the current position, the processor updates the first local time setting of the first local time, in correspondence to the computed current position.

7. The analog electronic timepiece according to claim 4, wherein:

the current position acquisition unit receives radio waves from positioning satellites and computes the current position based on the received radio waves from the positioning satellites; and when the current position acquisition unit acquires and computes the current position, the processor updates the first local time setting of the first local time, in correspondence to the computed current position.

8. The analog electronic timepiece according to claim 3, wherein:

the current position acquisition unit receives radio waves from positioning satellites and computes the current position based on the received radio waves from the positioning satellites.

9. The analog electronic timepiece according to claim 2, further comprising:

an operation receiving unit that receives a user operation, wherein:

the counting unit counts first local time and second local time, respectively;

the processor respectively acquires first and second time settings and respectively sets first and second time zones, in correspondence to the counted first and second local times; and the processor controls at least one of the hands to display the local time determination result, in correspondence to the first time setting and the first time zone, or in correspondence to the second time setting and the second time zone.

10. The analog electronic timepiece according to claim 9, wherein:

the processor switches the first local time setting of the first local time and the second local time setting of the second local time, in correspondence to a predetermined input operation on the operation receiving unit.

11. The analog electronic timepiece according to claim 10, wherein:

the current position acquisition unit receives radio waves from positioning satellites and computes the current position based on the received radio waves from the positioning satellites; and when the current position acquisition unit acquires and computes the current position, the processor updates the first local time setting of the first local time, in correspondence to the computed current position.

12. The analog electronic timepiece according to claim 9, wherein:

the current position acquisition unit receives radio waves from positioning satellites and computes the current position based on the received radio waves from the positioning satellites; and when the current position acquisition unit acquires and computes the current position, the processor updates the first local time setting of the first local time, in correspondence to the computed current position.

13. The analog electronic timepiece according to claim 2, wherein:

the current position acquisition unit receives radio waves from positioning satellites and computes the current position based on the received radio waves from the positioning satellites.

14. The analog electronic timepiece according to claim 1, further comprising:

an operation receiving unit that receives a user operation, wherein:

the counting unit counts first local time and second local time, respectively;

the processor respectively acquires first and second time settings and respectively sets first and second time zones, in correspondence to the counted first and second local times; and the processor controls at least one of the hands to display the local time determination result, in correspondence to the first time setting and the first time zone, or in correspondence to the second time setting and the second time zone.

15. The analog electronic timepiece according to claim 14, wherein:

the processor switches the first local time setting of the first local time and the second local time setting of the second local time, in correspondence to a predetermined input operation on the operation receiving unit.

16. The analog electronic timepiece according to claim 15, wherein:

the current position acquisition unit receives radio waves from positioning satellites and computes the current position based on the received radio waves from the positioning satellites; and when the current position acquisition unit acquires and computes the current position, the processor updates the first local time setting of the first local time, in correspondence to the computed current position.

17. The analog electronic timepiece according to claim 15, wherein:

the operation receiving unit receives a shift operation to a first selection setting state of the first time zone of the first local time and an ending operation of the first selection setting state;

the operation receiving unit receives a shift operation to a second selection setting state of the second time zone of the second local time and an ending operation of the second selection setting state;

the processor selects and sets the time zone in correspondence to an operation content received by the operation receiving unit;

the processor controls at least one of the plurality of hands to display the local time determination result of the first local time at the first selection setting state; and the processor controls at least one of the plurality of hands to display the local time determination result of the second local time at the second selection setting state.

18. The analog electronic timepiece according to claim 14, wherein:

the current position acquisition unit receives radio waves from positioning satellites and computes the current position based on the received radio waves from the positioning satellites; and when the current position acquisition unit acquires and computes the current position, the processor updates the first local time setting of the first local time, in correspondence to the computed current position.

19. The analog electronic timepiece according to claim 14, wherein:

the operation receiving unit receives a shift operation to a first selection setting state of the first time zone of the first local time and an ending operation of the first selection setting state;

the operation receiving unit receives a shift operation to a second selection setting state of the second time zone of the second local time and an ending operation of the second selection setting state;

the processor selects and sets the time zone in correspondence to an operation content received by the operation receiving unit;

the processor controls at least one of the plurality of hands to display the local time determination result of the first local time at the first selection setting state; and the processor controls at least one of the plurality of hands to display the local time determination result of the second local time at the second selection setting state.

20. The analog electronic timepiece according to claim 1, wherein:

the current position acquisition unit receives radio waves from positioning satellites and computes the current position based on the received radio waves from the positioning satellites.

* * * * *